United States Patent [19]

Sato et al.

[11] 4,215,992

[45] Aug. 5, 1980

[54] DYEING ASSISTANT FOR PRINTING

[75] Inventors: Toshio Sato; Shigeru Nagao, both of Wakayama, Japan

[73] Assignee: Kao Soap Co., Ltd., Tokyo, Japan

[21] Appl. No.: 967,140

[22] Filed: Dec. 6, 1978

[30] Foreign Application Priority Data

Dec. 26, 1977 [JP] Japan ..... 52-156949

[51] Int. Cl.[3] ..... D06P 5/04

[52] U.S. Cl. ..... 8/445; 8/580

[58] Field of Search ..... 8/169, 170, 172 R

[56] References Cited

U.S. PATENT DOCUMENTS

| | | | |
|---|---|---|---|
| 3,529,922 | 9/1970 | Berger et al. | 8/172 R |
| 3,822,113 | 7/1974 | Keenan et al. | 8/169 |
| 3,844,711 | 10/1974 | Daeuble et al. | 8/169 |
| 3,960,486 | 6/1976 | Daubach et al. | 8/172 R |

*Primary Examiner*—Maurice J. Welsh

*Attorney, Agent, or Firm*—Blanchard, Flynn, Thiel, Boutell & Tanis

[57] ABSTRACT

A dyeing assistant for use in printing color on hydrophobic fibers which comprises one or more esters of aliphatic polyhydric alcohols having 2–8 hydroxyl groups with fatty acids of 6–22 carbon atoms or ethylene oxide adducts thereof (component I), and one or more ethylene oxide adducts of aliphatic monoamines or diamines of 8–40 carbon atoms or quaternary ammonium salts thereof (component II).

9 Claims, No Drawings

DYEING ASSISTANT FOR PRINTING

BACKGROUND OF THE INVENTION

1. Field of the Invention

The present invention relates to a dyeing assistant for use in printing colors on cloths made of hydrophobic fibers. More particularly, the present invention relates to a dyeing assistant for printing of hydrophobic fibers which makes it possible to obtain uniform deep color printing of hydrophobic fiber cloths, sharp printing of complicated fine designs, efficient printing operation, maintenance of a soft feel after heat-treatment of the printed cloth and a sufficient dimensional stability of the cloth.

2. Description of the Prior Art

Knitted goods and textiles made of hydrophobic fibers, such as polyesters and triacetates, have heretofore been printed by applying to the fabric a printing paste containing a water-soluble thickener, a dye, an acid for pH regulation and a reduction-preventing agent, subjecting the thus-treated fabric to an intermediate drying treatment and then steaming the same with high pressure saturated steam at 120°–140° C. for 20–40 minutes to fix the dye.

However, recently, steaming has been effected using super-heated steam under atmospheric pressure or continuous fixing has been effected by the dry heat thermosol method in many cases for labor saving purposes.

The printing process wherein fixing is effected by the superheated steaming method (HTS method) or the dry heat thermosol method has a serious defect that if a conventional printing paste is used, the build-up rate of the dye is inferior to that obtained by the high pressure steam fixing process.

There have been numerous studies and patents relating to the elimination of said defect, i.e. to achieve an improvement in the build-up rate. For example, it is disclosed that ethylene oxide adducts of vegetable oils, etc. are suitable for this purpose in "American Dyestuff Reporter" May 25, 1964, (lines 5–14, the last column, page 419) and the same journal, July 19, 1965 (lines 17-3 from below, the last column, page 547). There have been published numerous patents related to those techniques. For example, in Japanese Patent Publications Nos. 8428/1967 and 8429/1967, polyhydric alcohol esters and ethylene oxide adducts of aromatic phenols are disclosed. However, by those techniques, level dyeing cannot be attained, because the fixing temperature is very high. In Japanese Patent Publication No. 38755/1970, ethylene oxide adducts of alkylamides are disclosed. In Japanese Patent Publication No. 30034/1969, phosphorus compounds are disclosed for use on acrylic fibers and polyamide fibers. In Japanese Patent Publication No. 8968/1971, a combination of a polyacrylic acid alkylene glycol ester and an alkoxylated compound prepared from phenol, formaldehyde and an amine by the Mannich reaction is disclosed. In Japanese Patent Publication No. 11473/1971, it is described that urea or ethylene urea is preferred for this purpose.

Particularly, the inventions disclosed in Japanese Patent Laid-Opens Nos. 29066/1972, 39776/1973, 66974/1974, 66975/1974, 72480/1974 and 90783/1975 relate to improving the build-up rate. Recently, the use of high molecular polyamine compounds as color development promotors has been proposed in Japanese Patent Laid-Opens Nos. 154584/1975, 1774/1976 and 19874/1976. Further, the joint use of a fatty acid glyceride and an ester of fatty acid and polyoxyethylene has been proposed in Japanese Patent Publication No. 1038/1977.

Although many ideas have been proposed, as described above, the fixing by the superheated steaming method or thermosol method has not been completely satisfactory yet for the reasons which will be described below.

As representative substances used for increasing the fixing rate, there have been used castor oil, ethylene oxide adducts of castor oil and sorbitan fatty acid esters. By using those substances, polyester and triacetate textiles can be printed continuously and the labor required for the HTS or thermosol fixing treatment in the printing process can be reduced. A dyeing deepness equivalent to or superior to that obtained by high pressure steaming in the batch system can be obtained and printed cloths having a substantially level hue in the range of from light to dark colors can be obtained. However, the above substances have still the following three disadvantages:

(1) There occurs a rubbing-off phenomenon whereby the dye is separated from the cloth in an intermediate drying step (i.e. a phenomenon in which the dye, before the fixing, is transferred to another portion of the cloth whereby to spoil the design).

(2) The feel of the cloth becomes rough and stiff after the application, drying and fixing steps due to the high temperature fixing step. This defect cannot be eliminated by desizing the cloth.

(3) In case of a design wherein a non-dyed white background is left, during the heat fixing step the rate of temperature elevation in the portions to which a printing paste has been applied differs from that in the portions to which the printing paste has not been applied and, therefore, a difference in textile elongation is caused which creases or wrinkles the cloth partially. The wrinkles cannot be eliminated easily by heat setting. This phenomenon is particularly remarkable in thin textiles such as voile and Georgette crepe.

For overcoming those defects, an idea has been proposed wherein an emulsion, dispersion or a solution of a combination of a fatty acid glyceride with a long chain aliphatic alcohol, an alkylphenol or a fatty acid/ethylene oxide adduct is used for improving the fixing in the printing. However, the dye agglutinates in the printing paste to cause specking in the printed products. If a polyoxyethylene glycol or polyoxyethylene alkyl ether is used as an emulsifying component, so-called "bleeding" is caused which makes clear printing impossible.

It has been reported further that if a fatty acid glyceride is added to the printing paste together with a fatty acid ester of polyoxyethylene glycol, the dye specking can be prevented whereby to obtain a dyed product of a level, deep color having a sufficiently sharp design.

However, all of the above described three defects could not be overcome by the conventional techniques.

After intensive investigations for the purpose of overcoming said defects, the inventors have discovered an excellent dyeing assistant useful in the printing of designs on cloths made of hydrophobic fibers. The present invention has been completed on the basis of this discovery.

SUMMARY OF THE INVENTION

The dyeing assistant for printing of hydrophobic fibers, according to the invention, comprises one or more esters of aliphatic polyhydric alcohols having 2–8 hydroxyl groups with fatty acids of 6–22 carbon atoms or ethylene oxide adducts thereof (component I), and one or more ethylene oxide adducts of aliphatic monoamines or diamines of 8–40 carbon atoms or quaternary ammonium salts thereof (component II).

If the component I is used alone, even though deep-colored, sharp designs can be obtained, the following defects cannot be avoided: the rubbing-off phenomenon cannot be prevented in the intermediate drying step after the application of the printing paste and the feel of the finished, printed cloth is stiff. When the design includes a non-dyed white background, the heating effects in the heat fixing step, particularly superheated steaming (HTS) step, are different between the parts to which a printing paste is applied and the parts to which the printing paste is not applied, whereby to cause differences in the elongation of the fibers and, accordingly, creases or wrinkles are formed, since the cloth is heated to 160°–210° C. without applying lateral tension to the cloth. The creases are not eliminated easily by heat setting.

If the dyeing assistant comprising components I and II is used with a dye or if it is incorporated in a printing paste, the above-described defects can be overcome successfully.

Namely, with the dyeing assistant of the present invention, the following advantages can be obtained: As a matter of course, the fixing rate of the dye is increased. The rubbing-off phenomenon can be prevented. The cloth thus printed has a very soft feel and excellent dimensional stability and it is free of creases. Further, by using the dyeing assistant of the present invention comprising components I and II for printing, the dye solution or printing paste exhibits an improved penetration in the fabric, the bleeding phenomenon is eliminated, sharpness is improved and quite excellent printabilities such as level-dyeing property and desizing property are obtained. Additional advantages are that the addition of the dyeing assistant according to the present invention does not exert a substantial influence on the viscosity of the sizing and the damage to the cloth is negligible. Further, the fastness (such as fastness to light, heat, etc.) of the printed cloths is not changed by the addition of the dyeing assistant according to the present invention in many cases and, sometimes, the fastness is rather increased.

As the aliphatic polyhydric alcohol moiety of ester component I according to the present invention, there can be mentioned, for example, polyhydric alcohols having 2–8 hydroxyl groups such as ethylene glycol, propylene glycol, glycerol, polyethylene glycol, sorbitan, sorbitol, pentaerythritol, trimethylolethane and trimethylolpropane. As the fatty acid moiety of ester component I, according to the invention, there can be mentioned saturated and unsaturated fatty acids of 6–22 carbon atoms, which may optionally contain a hydroxyl group, such as caproic acid, 2-ethylhexanoic acid, caprylic acid, capric acid, lauric acid, myristic acid, palmitic acid, stearic acid, oleic acid, ricinoleic acid, linolenic acid, behenic acid and hydroxystearic acid. The mono- and polyesters of those polyhydric alcohols and those fatty acids are obtained by dehydration reaction of those acids and polyhydric alcohols under conventional conditions. Ethylene oxide adducts of those esters are also prepared by a conventional process. Namely, they are prepared by a process wherein a monoester or polyester of a fatty acid and a polyhydric alcohol is added with ethylene oxide to cause an addition reaction, in the presence of a catalyst such as sodium hydroxide, potassium hydroxide, potassium methylate or sodium oleate, under pressure, or by an esterification process in case polyethylene glycol is used. The number of moles of ethylene oxide added to the ester is preferably 1–150.

Component II according to the present invention is prepared by a conventional process, i.e. it is synthesized by adding ethylene oxide to an aliphatic monoamine or diamine of 8–40 carbon atoms, preferably 8–22 carbon atoms, to effect an addition reaction, under heating, in the presence of an alkali catalyst such as sodium hydroxide, potassium hydroxide, potassium methylate or sodium oleate. The aliphatic monoamine or diamine is obtained by converting a fatty acid into a nitrile and then hydrogenating the same. As preferred aliphatic amines, there can be mentioned, for example, octylamine, caprylamine, laurylamine, oleylamine, stearylamine, behenylamine; secondary amines such as dilaurylamine and distearylamine; and N-lauroyl-N,N'-ethylenediamine, N-stearyl-N,N'-propylenediamine and N-oleyl-N,N'-ethylene-diamine. The average number of moles of ethylene oxide added is preferably 2–100. Quaternary ammonium salts of ethylene oxide adducts of those amines are obtained by a conventional process. Namely, the amine/ethylene oxide adduct is dissolved in a solvent such as isopropyl alcohol or propylene glycol in the presence of an alkali such as sodium carbonate. In case methyl chloride or methyl bromide is used, the reaction is carried out under elevated pressure and in case benzyl chloride or diethyl sulfate is used, the reaction is carried out under atmospheric pressure to obtain the quaternary ammonium compound.

Preferred examples of component II of the present invention thus obtained are shown by following general formulae (1)-(6):

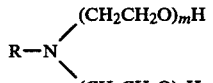

(1)

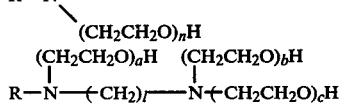

(2)

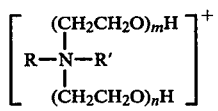

(3)

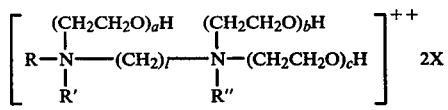

(4)

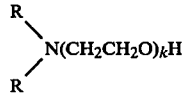

(5)

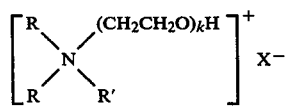

(6)

wherein R is alkyl having 8–22 carbon atoms, R' and R'' each is alkyl having 1–3 carbon atoms or benzyl, m+n, a+b+c and k each being 2–100, l is 2 or 3 and $X^{31}$ is halogen ($Cl^-$, $Br^-$, $I^-$) or $C_2H_5SO_4^-$.

Representative examples of component II are N,N-polyethenoxyoctylamine [$\bar{P}$(addition mole number of ethylene oxide)=20], N,N-polyethenoxystearylamine ($\bar{P}$=10, 50), N-polyethenoxydilaurylamine ($\bar{P}$=2), N-polyethenoxydistearylamine ($\bar{P}$=20, 100), N,N',N'-polyethenoxy-N-lauryl-N,N'-ethylenediamine ($\bar{P}$=15, 75), N,N',N'-polyethenoxy-N-oleyl-N,N'-ethylenediamine ($\bar{P}$=45) and quaternary ammonium salts of them.

The weight ratio of component I to component II is in the range of 1:1 to 100:1, preferably 3:1 to 100:5. The dyeing assistant of the present invention is selected so that it can be dissolved, emulsified or dispersed in water. The dyeing assistant of the invention is added in an amount of 0.3–10 wt. %, preferably 0.5–3 wt. %, based on the printing paste.

The hydrophobic fibers to which the dyeing assistant of the present invention is applicable include synthetic fibers such as polyethylene terephthalate fibers, various partially modified polyethylene terephthalate fibers, triacetate fibers and diacetate fibers. The fibers can be in the form of knitted goods or textiles. Further, the fibers can be other materials containing polyester fibers and acetate fibers such as mixed fibers and fabrics made of them together with cotton, rayon, wool, polyvinyl chloride, hemp or linen, polyamides and polypropylene.

The dyes used in combination with the dyeing assistant of the present invention are mainly disperse dyes including azo, azomethine, nitro and anthraquinone dyes.

The term "printing paste" herein means a viscous liquid comprising an aqueous solution of a sizing agent called "stock paste thickener" in this technical field, a dye, a pH regulator and a reduction-preventing agent. As sizing components used for the stock paste thickener, there can be mentioned locust beam gum, guar gum, CMC, sodium alginate, etherified starch and shilajatu gum sizing agents. One or more of the sizing agents are used in the form of a viscous aqueous solution having a concentration of 3–45 wt. %. The stock paste thickener is used in an amount of 10–80 wt. %, based on the weight of the printing paste. The viscosity of the paste is regulated suitably depending on the printing machine used and the shape of the cloth.

As the pH regulators, there can be mentioned tartaric acid, malic acid, ammonium sulfate and oxalic acid. As the reduction-preventing agents, there can be mentioned sodium m-nitrobenzenesulfonate and sodium chlorate. As the printing machine, there can be used any of the flat screen printing machines, rotary screen printing machines and roller printing machines used generally in the art.

The most suitable method of printing hydrophobic fibers with the printing paste containing the dyeing assistant of the present invention is a method widely employed in the art at present. Namely, the hydrophobic fibers to which the printing paste has been applied are fixed by subjecting the same to an intermediate drying treatment and subsequently heat treatment.

If the fixing is to be effected continuously, there is employed in many cases the thermosol process wherein the heating is effected with hot air at 170° to 210° C. or a hot plate such as a pile heater for 30 to 240 seconds or a steaming process wherein the heating is effected with superheated steam at 160°–190° C. under atmospheric pressure for 1–10 minutes. If the fixing is to be effected batchwise, a process is employed wherein steaming is effected with saturated steam at 110°–140° C. under a high pressure for 10 to 40 minutes. The present invention can be performed by any of the above processes. However, the former two processes are particularly advantageous from the economic viewpoint of increased productivity. After completion of the fixing, the fibers are washed in the usual manner. More particularly, a suitable order of washing processes is selected, such as, washing with water→washing with hot water→reductive washing (i.e. washing with hot water containing 2 g/l of each of an alkali, hydrosulfite and surfactant at 70°–90° C.)→washing with hot water→washing with water.

The following examples further illustrate the present invention. Percentages and parts are given by weight unless otherwise stated.

EXAMPLES

A printing paste was prepared according to the following recipe, wherein the dyeing assistant of the present invention or comparative dyeing assistant was used. The printing paste was applied to a cloth, dryed and fixed by heat treatment with superheated steam under atmospheric pressure.

Cloth sample:

Textile of processed polyester figers (Georgette)

Triacetate ("tropical" woolen cloth)

Composition of stock paste thickener:

Viscous aqueous solution containing the following components:

| | |
|---|---|
| Sorbitose C-5 (etherified starch) | 5% |
| Indarca PA-3 (guar gum) | 5% |
| Fine gum HE (CMC) | 4% |

Dyes:

For polyesters:

| | |
|---|---|
| Kayalon Polyester Orange RSF Paste (C.I. Disperse Orange 73) | 0.5 part |
| Kayalon Polyester Blue 2R-SF Paste | 3.5 |
| Kayalon Polyester Rubine 3G-LS Paste | 1.5 |
| For acetates: | |
| Cileacet Colour Blue RF (C.I. Disperse Blue 80) | 5 parts |

Composition of printing paste:

| | |
|---|---|
| Stock paste thickener | 60 parts |
| Dye | Above described |
| Malic acid | 3 |
| Dyeing assistant | 2 |
| Water | balance to make the total composition 100 parts |

Machines used:

Paste application:

Autoscreen printing machine [a product of Yamaguchi Kagaku Sangyo Co., Ltd., (Kyoto, Japan)]

Intermediate drying:

Pin tenter [a product of Tsujii Senki Kogyo Co., (Sakai city, Japan)]

Thermosol and atmospheric pressure superheat fixing:

HTS Steamer [a product of Yamaguchi Kagaku Sangyo Co., Ltd., (Kyoto, Japan)]

Atmospheric pressure superheated steaming: 180° C.×3 mins.
Thermosol: 190° C.×1 min.
After-washing:
Washing with running water for 30 secs.

| | | |
|---|---|---|
| Reductive washing: | Hydrosulfite | 2 g/l |
| | Sodium hydroxide | 1 |
| | Scourol 900 (Kao Soap Co.) | 2 |
| Washing with running water for 30 secs. | | |

Table 1

| | Dyeing Assistant No. | Composition | Component | Amount (parts) |
|---|---|---|---|---|
| Dyeing Assistants of the Invention | 1 | Sorbitan monostearate (Span 60; a product of Kao Atlas Co.) | (I) | 50 |
| | | Polyethenoxysorbitan monooleate ($\bar{P}$ = 20, Tween 80; a product of Kao Atlas Co.)* | (I) | 30 |
| | | N,N-Diethenoxy-N-stearylamine ($\bar{P}$ = 2) | (II) | 20 |
| | 2 | Polyethenoxysorbitan monooleate ($\bar{P}$ = 45 Tween 81) | (I) | 70 |
| | | N,N-Polyethenoxy-N-stearylamine ($\bar{P}$ = 30) | (II) | 30 |
| | 3 | Polyethenoxysorbitan monolaurate ($\bar{P}$ = 4 Tween 21) | (I) | 90 |
| | | N,N-Polyethenoxy-N-octylamine ($\bar{P}$ − 30) | (II) | 10 |
| | 4 | Hardened castor oil (acid value = 3.5) | (I) | 40 |
| | | Polyethenoxyoleic acid ester ($\bar{P}$ = 30) | (I) | 10 |
| | | N,N-Polyethenoxybehenylamine ($\bar{P}$ = 50) | (II) | 50 |
| | 5 | Polyethenoxy hardened castor oil ($\bar{P}$ = 25) | (I) | 35 |
| | | Pentaerythritol monostearate (PEMO, Kao Soap Co.) | (I) | 60 |
| | | N,N',N'-Polyethenoxy-N-stearyl-N,N'-ethylenediamine ($\bar{P}$ = 6) | (II) | 5 |
| | 6 | Polyethenoxy tallow fat ($\bar{P}$ = 2) | (I) | 65 |
| | | N,N',N'-Polyethenoxy-N-lauryl-N,N'-propylenediamine ($\bar{P}$ = 100) | (II) | 35 |
| | 7 | Polyethenoxy tallow fat ($\bar{P}$ = 15) | (I) | 97 |
| | | N,N-Polyethenoxy-N-stearyl-N-methylammonium chloride ($\bar{P}$ = 10) | (II) | 3 |
| | 8 | Polyethenoxystearic acid (Emanon 3199, $\bar{P}$ = 139) | (I) | 10 |
| | | Sorbitan monooleate (Span 80) | (I) | 85 |
| | | N,N-Polyethenoxylaurylbenzyl-ammonium bromide ($\bar{P}$ = 100) | (II) | 5 |
| | 9 | Polyethenoxysorbital trioleate (Rheodol 430, $\bar{P}$ = 30) | (I) | 90 |
| | | Polyethenoxydistearylmethyl-ammonium chloride ($\bar{P}$ = 20) | (II) | 10 |
| | 10 | Propylene glycol dioleate (acid value 10) | (I) | 70 |
| | | Polyethenoxycastor oil ($\bar{P}$ = 10) | (I) | 20 |
| | | N,N',N'-Polyethenoxy-N-stearyl-N,N'-dimethylethylenediammonium dichloride ($\bar{P}$ = 15) | (II) | 10 |
| | 11 | Trimethylolpropane dioleate | (I) | 50 |
| | | Polyethenoxylauric acid (Emanon 1112 ($\bar{P}$ = 10) | (I) | 20 |
| | | Polyethenoxydistearylamine ($\bar{P}$ = 50) | (II) | 30 |
| Comparative dyeing Assistants | 12 | Sorbitan monostearate (Span 60) | (I) | 62.5 |
| | | Polyethenoxysorbitan monooleate Tween 80, $\bar{P}$ = 20) | (I) | 37.5 |
| | | (Composition of No. 1 but excluding component (II)) | | |
| | 13 | Pentaerthyritol monostearate | (I) | 63 |
| | | Polyethenoxy hardened castor oil ($\bar{P}$ = 25) | (I) | 37 |
| | | (Composition of No. 5 but excluding component (II)) | | |
| | 14 | Hardened tallow monoglyceride | (I) | 80 |
| | | Polyethenoxyoleic acid (Emanon 4115, ($\bar{P}$ = 15) | (I) | 20 |
| | 15 | N,N-Polyethenoxybehenylamine ($\bar{P}$ = 50) (only component (II)) | (II) | 100 |
| | 16 | Polyethenoxydistearylmethylammonium chloride ($\bar{P}$ = 20) (only component (II)) | (II) | 100 |
| | 17 | Polyethenoxy tallow fat ($\bar{P}$ = 15) | (I) | 97 |
| | | Distearyldimethylammonium chloride (Quatamine D 86 P) (the same as No. 7 except for component (II)) | — | 3 |
| | 18 | Polyethenoxysorbital trioleate | (I) | 95 |

Table 1-continued

| Dyeing Assistant No. | Composition | Component | Amount (parts) |
|---|---|---|---|
| | (Rheodol 430, $\bar{P}$ = 30) N,N''-Distearoylamidoethyl-N',N'-diethylammonium chloride | — | 5 |

Note:

These compositions are in the form of a transparent liquid, soft paste or solid but their viscosities are reduced at a temperature above 50° C.

*$\bar{P}$ = Ethylene oxide addition mole number

The dyeabilities and other properties of the printed polyester and triacetate cloths obtained as above and other cloths were examined. The results shown in Tables 2 and 3 were obtained. The properties were estimated by the following methods:

Dispersibility:

The paste was placed on a sheet of coated paper, spread out with a roll coater (a product of Azumaya Tekko-sho, Amagasaki city, Japan) and dried to examine whether the dye agglomerates in the printing paste to cause specking.

| | |
|---|---|
| Good dispersibility | 1 |
| Medium | 2 |
| Poor | 3 |

Level-dyeing property, sharpness:

The printed cloth was examined with the naked eye.

| | |
|---|---|
| The figures are sharp and the dyeing is level | 1 |
| The figures are partially unclear and the dyeing is not level | 2 |
| The figures are unclear and the dyed cloth has partially uneven deepness in color | 3 |

Measurement of rubbing:

Fastness of the cloth was measured with a device of measuring color fastness to rubbing of "Japan Society for Promotion of Scientific Research" type according to JIS L-0849.

Measurement of feeling:

Absolute bending rigidity was measured with Kawabata type feeling tester KES-F3 (a product of Kato Tekko Co.). unit: gcm/cm$^2$ Dimensional stability:

Pieces of gauze were printed. The figures were (a) checkerboards (5 cm×5 cm or 1 cm×1 cm) comprising squares to which a color paste was applied and white squares to which the paste was not applied which are arranged alternately and (b) oblique lines (5 mm colored bands and 3 mm white ground arranged alternately). In the checkerboards, the cloth had an uneven surface when the dyeing assistant was not used. The results were appraised with the naked eye as follows:

| | |
|---|---|
| Cloth completely free of creases or unevenness | 1 |
| Cloth of medium results | 2 |
| Uneven cloth with creases | 3 |

Table 2

| | Dyeing assistant No. | Printing of polyester Georgette: Color fastness to rubbing | Absolute bending rigidity* | Dimensional Stability | Suitability for printing: Level-dyeing | Sharpness | Dispersibility |
|---|---|---|---|---|---|---|---|
| | Not added | 3–4 | 0.062 | 3 | 1 | 1 | 1 |
| Examples of the present Invention | 1 | 4–5 | 0.032 | 1 | 1 | 1 | 1 |
| | 2 | 4–5 | 0.028 | 1 | 1 | 1 | 1 |
| | 3 | 5 | 0.035 | 1 | 1 | 1 | 1 |
| | 4 | 4–5 | 0.029 | 1 | 1 | 1 | 1 |
| | 5 | 5 | 0.033 | 1 | 1 | 1 | 1 |
| | 6 | 4–5 | 0.033 | 1 | 1 | 1 | 1 |
| | 7 | 5 | 0.027 | 1 | 1 | 1 | 1 |
| | 8 | 5 | 0.030 | 1 | 1 | 1 | 1 |
| | 9 | 4–5 | 0.027 | 1 | 1 | 1 | 1 |
| | 10 | 4 | 0.026 | 1 | 1 | 1 | 1 |
| | 11 | 4 | 0.035 | 1 | 1 | 1 | 1 |
| Comparative Examples | 12 | 3 | 0.059 | 3 | 1 | 3 | 2 |
| | 13 | 2–3 | 0.060 | 3 | 1 | 3 | 1 |
| | 14 | 2–3 | 0.072 | 3 | 2 | 2 | 1 |
| | 15 | 2 | 0.065 | 2 | 3 | 1 | 3 |
| | 16 | 2–3 | 0.062 | 2 | 3 | 1 | 3 |
| | 17 | 3–4 | 0.058 | 1 | 3 | 1 | 3 |
| | 18 | 3 | 0.057 | 2 | 3 | 1 | 3 |

*Average of the warp and weft in the parts applied with the color paste.

Table 3

| | Dyeing assistant No. | Color fastness to rubbing | Printing of triacetate: Absolute bending rigidity | Dimensional stability | Suitability for printing: Level-dyeing | Sharpness | Dispersibility |
|---|---|---|---|---|---|---|---|
| | Not added | 3–4 | 0.102 | 3 | 1 | 1 | 1 |
| Examples of the present Invention | 1 | 4–5 | 0.062 | 1 | 1 | 1 | 1 |
| | 2 | 4–5 | 0.058 | 1 | 1 | 1 | 1 |
| | 3 | 4–5 | 0.055 | 1 | 1 | 1 | 1 |
| | 4 | 4 | 0.076 | 1 | 1 | 1 | 1 |
| | 5 | 4–5 | 0.065 | 1 | 1 | 1 | 1 |
| | 6 | 4–5 | 0.048 | 1 | 1 | 1 | 1 |
| | 7 | 4–5 | 0.055 | 1 | 1 | 1 | 1 |
| | 8 | 4–5 | 0.061 | 1 | 1 | 1 | 1 |
| | 9 | 4 | 0.077 | 1 | 1 | 1 | 1 |
| | 10 | 4–5 | 0.069 | 1 | 1 | 1 | 1 |
| | 11 | 5 | 0.051 | 1 | 1 | 1 | 1 |
| Comparative Examples | 12 | 3–4 | 0.097 | 3 | 1 | 3 | 1 |
| | 13 | 3–3 | 0.111 | 3 | 1 | 3 | 1 |
| | 14 | 3–4 | 0.109 | 3 | 2 | 1 | 1 |
| | 15 | 3 | 0.089 | 2 | 3 | 1 | 3 |
| | 16 | 2–3 | 0.095 | 2 | 3 | 1 | 3 |
| | 17 | 3 | 0.121 | 2 | 3 | 1 | 3 |
| | 18 | 3–4 | 0.104 | 3 | 3 | 1 | 3 |

Tables 2 and 3 suggest that if component I according to the invention is used alone, the sharpness is poor as in dyeing assistants Nos. 12–14 and if component II is used alone, dispersibility and level-dyeing property are inferior as in dyeing assistants Nos. 15–16. In case a dyeing assistant of No. 17 or 18 comprising a combination of a cationic surfactant free of ethylene oxide chain and component I is used, specks of the dye are formed and they have inferior level-dyeing property and dispersibility. In all of the cases, the printed cloths have inferior color fastness to rubbing, rigidity and dimensional stability. It is thus understood that printed cloths have remarkably improved rubbing resistance, soft feel and excellent dimensional stability cannot be obtained unless the combination of components I and II is used.

It has been found further that the cloths exhibit excellent desizing property, dye-penetrability and various fastnesses.

The embodiments of the invention in which an exclusive property or privilege is claimed are defined as follows:

1. A dyeing assistant composition for use in applying color on hydrophobic fibers, consisting essentially of I. one or a mixture of esters of aliphatic hydrocarbon polyhydric alcohols having 2 to 8 hydroxyl groups selected from the group consisting of ethylene glycol, propylene glycol, glycerol, polyethylene glycol having an average of from 2 to 5 ethylene oxide units, sorbitan sorbitol, pentaerythritol, trimethylolethane and trimethylolpropane, with fatty acids having 6 to 22 carbon atoms, or ethylene oxide adducts of said esters, and II. one or a mixture of ethylene oxide adducts of aliphatic monoamines or diamines having 8 to 40 carbon atoms, or quaternary ammonium salts of said adducts, wherein the weight ratio of I:II is in the range of from 1:1 to 100:1.

2. A dyeing assistant composition according to claim 1 wherein the weight ratio of I:II is in the range of from 3:1 to 100:5.

3. A dyeing assistant composition according to claim 1 or claim 2 wherein said fatty acid moiety of I is selected from the group consisting of caproic acid, 2-ethylhexanoic acid, caprylic acid, capric acid, lauric acid, myristic acid, palmitic acid, stearic acid, oleic acid, ricinoleic acid, linolenic acid, behenic acid and hydroxystearic acid.

4. A dyeing assistant composition according to claim 1 in which said ethylene oxide adduct of said ester contains from 1 to 150 moles of adducted ethylene oxide.

5. A dyeing assistant composition according to claim 1 or claim 4 in which said ethylene oxide adduct of said aliphatic monoamine or diamine contains an average of 2 to 100 moles of adducted ethylene oxide.

6. A dyeing assistant composition according to claim 5 in which said aliphatic monoamine or diamine contains 8 to 22 carbon atoms.

7. A dyeing assistant composition according to claim 1 in which component II is one or a mixture of compounds having the formulas

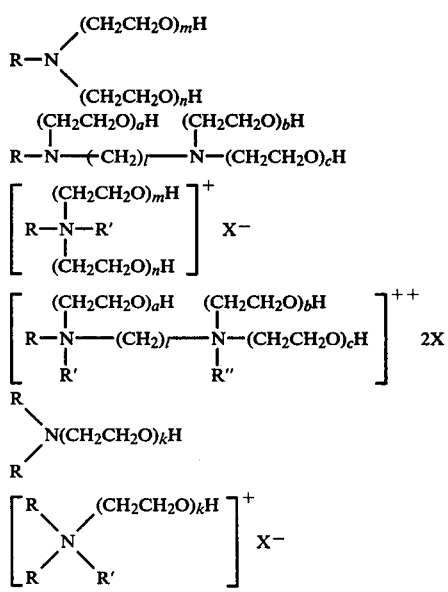

wherein R is alkyl having 8 to 22 carbon atoms, each of R′ and R″ is alkyl having 1 to 3 carbon atoms or benzyl, m+n is from 2 to 100, a+b+c is from 2 to 100, k is from 2 to 100, l is 2 or 3, and X is Cl, Br, I or $C_2H_5SO_4$.

8. In a printing paste composition for use in applying color on hydrophobic fibers comprising an aqueous liquid containing a sizing agent, a dye, a pH regulator and a reduction-preventing agent, the improvement which comprises: said paste contains from 0.3 to 10% by weight of a dyeing assistant composition as claimed in claim 1.

9. A method of applying color on hydrophobic fibers which comprises applying to said fibers a printing paste composition as claimed in claim 8, then fixing said paste to said fibers, and then washing said fibers.

* * * * *